US010049790B2

(12) United States Patent
Studer

(10) Patent No.: US 10,049,790 B2
(45) Date of Patent: Aug. 14, 2018

(54) ELECTRICAL CABLE

(71) Applicant: Christoph Studer, Gretzenbach (CH)

(72) Inventor: Christoph Studer, Gretzenbach (CH)

( * ) Notice: Subject to any disclaimer, the term of this patent is extended or adjusted under 35 U.S.C. 154(b) by 0 days.

(21) Appl. No.: 15/503,063

(22) PCT Filed: Aug. 10, 2015

(86) PCT No.: PCT/EP2015/068394
§ 371 (c)(1),
(2) Date: Feb. 10, 2017

(87) PCT Pub. No.: WO2016/023872
PCT Pub. Date: Feb. 18, 2016

(65) Prior Publication Data

US 2017/0229215 A1 Aug. 10, 2017

(30) Foreign Application Priority Data

Aug. 11, 2014 (CH) ..... 1213/14

(51) Int. Cl.
*H01B 7/00* (2006.01)
*H01B 9/04* (2006.01)
*H01B 9/00* (2006.01)
*H01B 1/02* (2006.01)

(52) U.S. Cl.
CPC ..... *H01B 9/04* (2013.01); *H01B 9/003* (2013.01); *H01B 1/026* (2013.01); *H01B 9/006* (2013.01)

(58) Field of Classification Search
CPC ..... H01B 7/0823; H01B 13/143
USPC ..... 174/110 R, 112, 113 R, 117 R, 102 R
See application file for complete search history.

(56) References Cited

U.S. PATENT DOCUMENTS 2,729,696 A * 1/1956 Hull ..... H01B 7/38
174/117 F
3,621,118 A * 11/1971 Bunish ..... H01B 7/08
174/115
5,110,999 A * 5/1992 Barbera ..... H01B 11/12
174/107

(Continued)

FOREIGN PATENT DOCUMENTS

EP 1236764 A1 9/2002
EP 2811491 B1 11/2016

(Continued)

OTHER PUBLICATIONS

Leoni Studer AG, BETAjet 400, FRNC-betaflex, Feb. 1, 2008.

(Continued)

*Primary Examiner* — William H Mayo, III
(74) *Attorney, Agent, or Firm* — Brian Roffe

(57) ABSTRACT

Electrical cable for supplying aircraft and similar devices with alternating current having at least partially higher frequencies of preferably 400 Hz. The cable is provided with a central neutral and/or return conductor and at least six phase conductors arranged in a concentrically distributed manner about the neutral and/or return conductor, wherein every phase is distributed on two symmetrically opposing phase conductors. The neutral and/or return conductor is formed, in a very space-saving manner and with low inductivity, by six individually insulated compact neutral wires, the total cross-section of which approximately corresponds to the cross-section of an individual solid neutral wire.

20 Claims, 1 Drawing Sheet

(56) References Cited

U.S. PATENT DOCUMENTS

| | | | | |
|---|---|---|---|---|
| 5,451,718 | A * | 9/1995 | Dixon | H01B 7/285 156/54 |
| 6,376,775 | B1 * | 4/2002 | Leijon | H01F 3/10 174/128.1 |
| 7,154,038 | B2 | 12/2006 | Studer | |
| 7,164,084 | B2 | 1/2007 | Studer | |
| 8,579,652 | B2 | 11/2013 | Flach | |
| 9,545,743 | B2 * | 1/2017 | Joyce | H01B 7/0823 |
| 2003/0168229 | A1 * | 9/2003 | Whidden | H01B 9/029 174/389 |
| 2010/0307811 | A1 * | 12/2010 | Griffin | H01B 11/12 174/350 |
| 2015/0107868 | A1 * | 4/2015 | Hassel | H01B 7/285 174/24 |
| 2016/0125539 | A1 * | 5/2016 | Kaya | G06Q 40/06 705/36 R |

FOREIGN PATENT DOCUMENTS

| | | | |
|---|---|---|---|
| WO | 2007054325 | A1 | 5/2007 |
| WO | 2016023872 | A1 | 2/2016 |

OTHER PUBLICATIONS

BETAjet®- BETAlux®, 400 Hz ground power cables 5 kV airfield lighting cables, downloaded on Feb. 9, 2017 from wwwleoni-transportation.com/en/products/airport/airplane-ground-power-cables/.

BETAjet 400 FRNC-smartflex-V2, Highly flexible 400 Hz ground power cable, downloaded on Feb. 9, 2017 from wwwleoni-transportation.com/en/products/airport/airplane-ground-power-cables/.

BETAjet® 400 Hz cables for supply unit of helicopters and aircrafts on board, downloaded on Feb. 9, 2017 from wwwleoni-transportation.com/en/products/airport/airplane-ground-power-cables/.

* cited by examiner

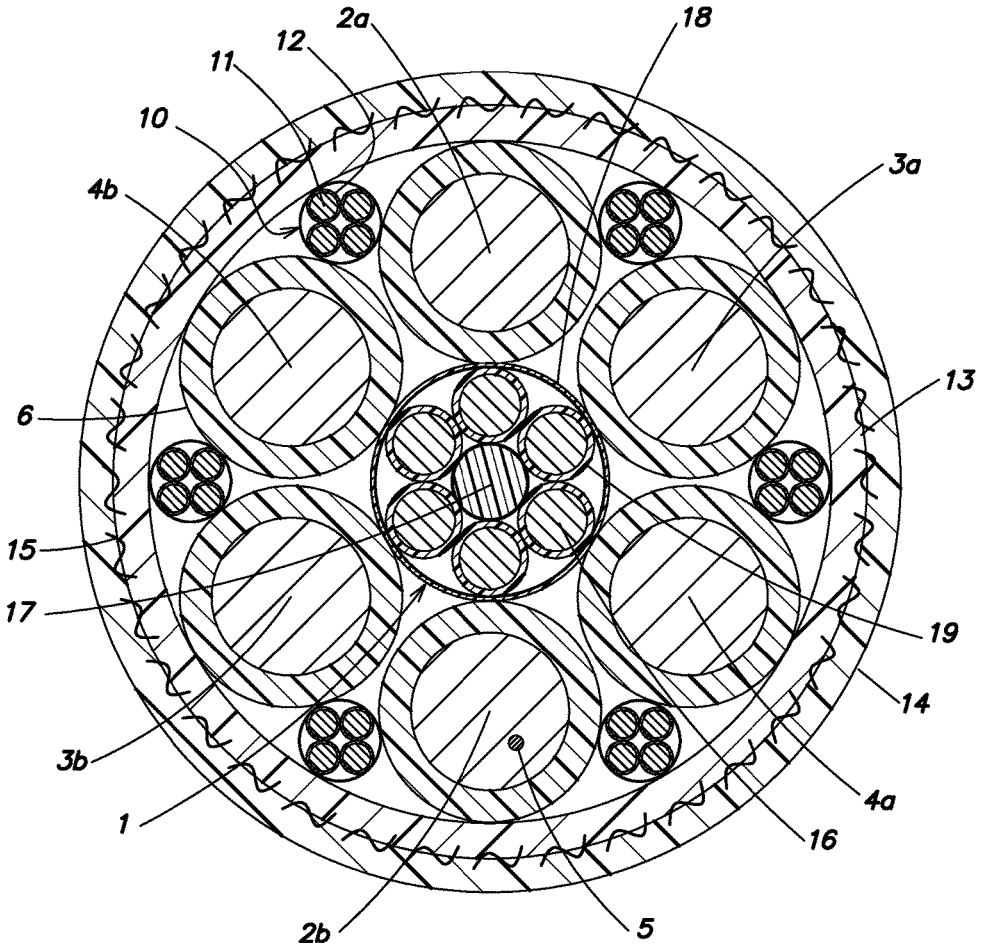
2a
18
12
11
10
3a
4b
13
6
15
17
19
14
3b
4a
1
16
2b
5

ELECTRICAL CABLE

FIELD OF THE INVENTION

The invention relates to an electrical cable for supplying electricity to an aircraft, an engine or similar, for at least partially higher frequencies of preferably 400 Hz, comprising a central neutral and/or return conductor and at least six phase conductors arranged in a concentrically distributed manner about the latter.

BACKGROUND OF THE INVENTION

Such electrical cables are used for the conveyance of large currents with high frequencies in aircraft and in the ground. By means of the overall symmetrical structure and the phase construction distributed over two conductors, they also have symmetrical and optimally reduced inductive voltage drops with a minimized skin effect, and so are used especially for longer stretches. In aircraft in particular, the supply of electricity with high-frequency current is well known to offer the advantage that as a result, lighter generators, engines and similar, in particular inductively acting components and equipment can be used in the aircraft.

With the previously known electrical cables of this type, the neutral and/or return conductor is made in the form of a one-part, solid or flexible neutral wire, the symmetrical structure of the cable meaning that the neutral wire is guided in the center of the cable. These known electrical cables totally satisfy the requirements if they are laid in a fixed manner.

When using the cable as a flexible service cable, as is the case when using the same as an electrical supply cable for aircraft, when not being used they are rolled up on reels or upon docking they are unrolled by the aircraft and are then pulled over the asphalt surface or similar. The case then arises where there is an active single conductor in the middle of the cable which is subjected to strong mechanical loading due to torsion because the supply cable is subjected recurrently to bending stress due to the repeated rolling up and unrolling.

This results in the risk of the neutral and/or return conductor of the cable being damaged by the strong bending stress, and so the cable becomes inoperable. In the past attempts have been made to compensate for this disadvantage by a mechanically reinforced core in the central neutral wire. However, this type of construction may nevertheless lead to breakage of the central conductor depending on the loading and life span of the cable, but at a later point in time than with comparable electrical cables with an unreinforced central conductor.

With generic cables the neutral conductor generally only has half the cross-section of the phase conductors (each with 2 phases). In particular, since single-phase asymmetrical consumers with connected power supplies on board bring about an addition to the harmonic waves that are generated in the neutral conductor, the skin effect, and so the loading, is disadvantageously increased in the latter.

OBJECTS AND SUMMARY OF THE INVENTION

The object underlying the invention is to devise an electrical cable of the type specified at the start and which has optimal flexibility and resistance to torsion, but nevertheless guarantees optimal electrical values without the risk of breakage of the central neutral and/or return conductor.

Furthermore, the disadvantageous skin effect in the neutral or return conductor should be reduced while retaining the same diameter of the neutral conductor.

According to the invention this object is achieved by the neutral and/or return conductor being made up of a number of individually insulated neutral wires, the total cross-section of which approximately corresponds to the cross-section of an individual solid central conductor.

By means of this construction, a structure of the cable center is produced with only one loadable, non-electrical central element by means of which better mechanical properties are produced, without the cable center with all of the neutral conductors becoming thicker than with conventional constructions. As a result, the phase insulation does not have to be unnecessarily thicker in order to fulfill the geometric dimensions for the layer stranding.

By means of the construction of the cable according to the invention it is also possible, despite the multi-part structure of the central neutral conductor, to retain the small inductivity covering, i.e. to guarantee a compact conductor construction. Specifically with 3-phase alternating currents with 400 Hz this is very important because each increase in inductivity brings about an 8 times higher inductive voltage drop than would be the case with 50 Hz currents. With a respectable proportion of harmonic waves as a result of static converters or electronic consumers, the importance in this regard increases once again.

At the same time, the new cable construction allows redundancy of the central neutral and/or return conductor since with the central neutral and/or return conductor, unlike with conventional constructions with only one solid neutral wire, it is practically out of the question that all six single conductors of the multi-part neutral wire can break at the same time. As a result, the risk of a neutral wire breakage is therefore very greatly reduced because there is no longer an active conductor in the center of the electrical cable and multiple redundancy is effective.

Further advantageous embodiments of the invention include features set forth in dependent claims.

BRIEF DESCRIPTION OF THE DRAWINGS

In the following the invention is described in more detail by means of an exemplary embodiment with reference to the drawings. This shows:

FIG. 1 is a cross-section of an electrical cable according to the invention.

DETAILED DESCRIPTION OF THE INVENTION

The electrical cable shown in FIG. 1 has a central combination of wires as the neutral and/or return conductor 1 as well as six phase conductors 2*a*, 2*b*, 3*a*, 3*b*, 4*a*, 4*b* arranged evenly in a concentrically distributed manner about the latter, each phase being distributed over two symmetrically opposing phase conductors 2*a*, 2*b*, 3*a*, 3*b*, or 4*a*, 4*b*.

The six phase conductors 2*a* to 4*b* have, for example, a cross-section of 35 $mm^2$ and are produced from bare and fine-wired copper strands 5. These copper strands 5 are designed according to the IEC 60228 standard, at least class 5, each phase conductor being provided with insulation 6 composed of preferably cross-linked plastic insulation, for example EPR.

Furthermore, the electrical cable is equipped with an inner sheath 13 made of orange-colored polyurethane as a wear indicator, and an outer sheath 14 made of yellow-colored polyurethane with fiber reinforcement 15 lying in between. Needless to say, other colors could also be used.

According to the invention the electrical cable is made up from six individually insulated neutral wires 16 each with individual insulation 19, the neutral wires 16 and also the phase conductors 2*a*, 2*b*, 3*a*, 3*b*, 4*a*, 4*b* each being formed from a plurality of wires.

Advantageously, the neutral wires 16 are made with SRC (Special Round Conductor) cores or Unilay strands, each with a cross-section of 6 $mm^2$, i.e. a total of 36 $mm^2$, and this corresponds to the cross-section of a conventional, non-distributed neutral wire. In one embodiment, the neutral wires 16 are each produced from one or more strands with a high degree of filling from the thin wires with a copper structure. The neutral wires 16 may be produced from SRC strands or Unilay strands. The neutral wires 16 may be are made of twisted wires with a diameter of between 0.05 mm and 0.75 mm. The neutral wires 16 may be made of bunched strands without a geometric structure, each with a plurality of wires, for example between 700 and 800, with the cross-section of 6 $mm^2$, and these are surrounded by a film as insulation 19.

With a known solid neutral wire, a number of strands are generally wound like a cable around a center, which strands are produced, cross-linked, from copper strands, bare and fine-wired, with insulation made of EPR.

The individual neutral wires 16 of the distributed neutral and/or return conductor 1 are arranged about a central element 17 made of plastic material and have a thin casing 18 or banding encompassing them, also made of insulating material. The neutral wires 16 are produced from fine-wired copper strands and are individually insulated with thin-walled and electron beam cross-linked insulation 19 made of a preferably cross-linked plastic, for example a polyolefin copolymer. In one embodiment, the neutral wires 16 are each provided with very thin and cross-linked insulation (19) made of plastic and which has a wall thickness of 0.1 mm to 1 mm.

By means of the structure according to the invention of the central neutral and/or return conductor 1, in comparison to the prior art, the risk of breakage of the central conductor can be greatly reduced without changing the overall cross-section of the cable and having any negative impact upon its excellent electrical properties. Since in practice, not all six individual neutral wires 16 can break at the same time, multiple redundancy of the neutral wire distributed according to the invention is produced, and this is associated with a strong reduction of the risk of a neutral wire breakage, especially as there is no active conductor in the geometric center of the cable.

Within the framework of the invention the electrical cable comprises outer thin cables 10 additionally distributed evenly around the circumference on the outside between the adjacent phase conductors 2*a*, 2*b*, 3*a*, 3*b*, 4*a*, 4*b*, which have conductors 11 in fours each being 4×1 $mm^2$ and which are also provided as fine-wired copper strands each with insulation 12 which is in turn preferably made of cross-linked plastic insulation.

Advantageously the stranding direction of the insulated neutral wires 16 is to be chosen to be the same as that of the phase conductors 2*a*, 2*b*, 3*a*, 3*b*, 4*a*, 4*b*. The lay lengths are to be determined in relation to one another here such that with torsion, the length changes of the neutral wires lying on the inside are approximately the same as those of the outer phase conductors.

As a variation, additional neutral wires can be contained in the outer thin cables of the cable, by means of which a further increase of the overall cross-section of the neutral and/or return conductor is made possible, for example over the full phase cross-section.

The invention claimed is:

1. An electrical cable for supplying electricity, comprising:

a central neutral and/or return conductor; and at least a number of phase conductors arranged in a concentrically distributed manner about the central neutral and/or return conductor, the central neutral and/or return conductor comprising a number of neutral wires each with individual insulation, the neutral wires and the phase conductors each being formed from a plurality of wires.

2. The electrical cable according to claim 1, further comprising a non-electrically conductive central element about which the neutral wires are arranged.

3. The electrical cable according to claim 2, wherein the number of neutral wires is six.

4. The electrical cable according to claim 1, wherein the neutral wires are each produced from one or more strands with a high degree of filling from the wires with a copper structure.

5. The electrical cable according to claim 1, wherein the neutral wires are produced from SRC strands or Unilay strands.

6. The electrical cable according to claim 1, wherein the neutral wires are made of twisted wires with a diameter of between 0.05 mm and 0.75 mm.

7. The electrical cable according to claim 1, wherein the neutral wires are made of bunched strands without a geometric structure, each with a plurality of wires with a cross-section of 6 $mm^2$, and these are surrounded by a film as insulation.

8. The electrical cable according to claim 7, wherein the plurality of wires of the neutral wires comprises between 700 and 800 wires.

9. The electrical cable according to claim 1, wherein the neutral wires are each provided with very thin and cross-linked insulation made of plastic and which has a wall thickness of 0.1 mm to 1 mm.

10. The electrical cable according to claim 1, further comprising at least one outer thin cable, each with a number of additional conductors, respectively guided on the outside between adjacent ones of phase conductors.

11. The electrical cable according to claim 10, wherein there are four of the additional conductors in the at least one outer thin cable, each of the additional conductors being provided with insulation.

12. The electrical cable according to claim 10, further comprising:

an inner sheath that encloses the phase conductors, that are each distributed over two symmetrically opposing phase conductors, and the additional conductors, the inner sheath being made of a coloured colored plastic surrounding the latter phase conductors and the additional conductors, and an outer sheath surrounding the inner sheath and being made of a plastic of a different color than the color of the colored plastic from which the inner sheath is made.

13. The electrical cable according to claim 12, further comprising reinforcement material between the inner sheath and the outer sheath.

14. The electrical cable according to claim 1, wherein a stranding direction of the neutral wires runs in a common direction as a direction of the phase conductors.

15. The electrical cable according to claim 14, wherein lay lengths are determined in relation to one another such that with torsion, length changes of the neutral wires lying on an inside are approximately the same as those of the phase conductors.

16. The electrical cable according to claim 1, wherein the electrical cable is configured to supply electricity to an aircraft, an engine or similar.

17. The electrical cable according to claim 1, wherein the electrical cable is configured to supply electricity for at least partially higher frequencies of 400 Hz.

18. The electrical cable according to claim 1, wherein the number of neutral wires is six.

19. The electrical cable according to claim 1, further comprising:

an inner sheath that encloses the phase conductors and the central neutral and/or return conductor, the inner sheath being made of a colored plastic, and an outer sheath surrounding the inner sheath and being made of a plastic of a different color than the color of the colored plastic from which the inner sheath is made.

20. The electrical cable according to claim 1, wherein central neutral and/or return conductor comprises a non-electrically conductive central element about which the neutral wires are arranged.

* * * * *